US007338041B2

(12) United States Patent
Taiji

(10) Patent No.: US 7,338,041 B2
(45) Date of Patent: Mar. 4, 2008

(54) IMAGE RECORDING MATERIAL SUPPLY APPARATUS AND METHOD

(75) Inventor: Akira Taiji, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 362 days.

(21) Appl. No.: 11/088,887

(22) Filed: Mar. 25, 2005

(65) Prior Publication Data

US 2005/0242489 A1 Nov. 3, 2005

(30) Foreign Application Priority Data

Apr. 28, 2004 (JP) ..... 2004-133762

(51) Int. Cl.
*B65H 3/44* (2006.01)

(52) U.S. Cl. ..... 271/9.03; 271/9.08; 271/162; 414/277; 414/280

(58) Field of Classification Search ..... 271/9.01, 271/9.03, 9.05, 9.08, 9.11, 9.12, 162; 414/795.4, 414/277, 280
See application file for complete search history.

(56) References Cited

U.S. PATENT DOCUMENTS 6,341,932 B1 1/2002 Otsuji

FOREIGN PATENT DOCUMENTS

JP 2000-247489 12/2000
JP 2003-287899 10/2003

*Primary Examiner*—Patrick Mackey
*Assistant Examiner*—Michael C McCullough
(74) *Attorney, Agent, or Firm*—McDermott Will & Emery

(57) ABSTRACT

For replacing a cassette 9 in an automatic loader section 4, an operation of retracting the cassette 9 to a cassette accommodation section 3 is performed in parallel with an operation of inserting a new cassette 9 from the cassette accommodation section 3 to the automatic loader section 4. Accordingly, the time required by the automatic loader section 4 for the cassette replacement operation is the same as the longer time among the time for retracting the cassette and the time for inserting the cassette. Thus, the time in which the automatic loader section 4 must stop the transportation of the image recording materials can be shortened.

8 Claims, 13 Drawing Sheets

IMAGE RECORDING MATERIAL SUPPLY APPARATUS AND METHOD

BACKGROUND OF THE INVENTION

1. Field of the Invention

The present invention relates to an image recording material supply apparatus and method, and more specifically to an image recording material supply apparatus and method for automatically supplying a sheet-form image recording material such as a press plate or a film loaded on a cassette.

2. Description of the Background Art

Conventionally, there are image recording apparatuses for directly recording an image by irradiating an image recording material with laser light. Image recording material supply apparatuses for automatically supplying an image recording material to an image recording apparatus have been developed. In the following, a specific description will be given using an example in which a press plate such as a PS plate (Presensitized Plate) or a thermal plate is used as the image recording material and such a press plate is supplied from a press plate supply apparatus to an image recording apparatus. A press plate used in such an image recording apparatus includes a support layer and an image recording layer. Since the image recording layer is easily damaged, a very close attention is required when removing the press plate.

Press plates which are to be supplied to the press plate supply apparatus are accommodated in a cassette. A plurality of press plates are loaded on the cassette in the state where the support layer is at the upper surface. In order to prevent friction between the press plates loaded on the cassette, interleaves are occasionally inserted alternately with the press plates. For example, a press plate supply apparatus disclosed in Japanese Laid-Open Patent Publication No. 2000-247489 includes a movable arm or the like having an adsorption plate for adsorbing a press plate. The adsorption plate adsorbs and thus secures the support layer (at the upper surface) of a press plate by a negative pressure, and in this state, the movable arm moves the adsorption plate to a predetermined position. In this manner, the press plate is removed from the cassette and supplied to the image recording apparatus. In the case where the interleaves are also loaded, each time the movable arm or the like removes a press plate from the cassette, a movable adsorption plate for adsorbing an interleaf adsorbs and thus secures the interleaf, and in this state, the movable adsorption plate is moved to a predetermined position. In this manner, the Interleaf is discharged outside the press plate supply apparatus. Specifically, a press plate which is adsorbed and thus held at the support layer thereof by the adsorption plate is inverted upside down such that the supply layer is at the lower surface, and is transported with a leading end thereof directed toward the image recording apparatus.

A cassette which is to be set in the press plate supply apparatus is supplied from a cassette accommodation apparatus and located at a position where the press plates are transportable by the movable arm (press plate transportation position). Among the press plates loaded on the cassette, the press plate at the uppermost position in the cassette is the target of transportation and supply. As shown in FIG. 13, a cassette accommodation apparatus 510 accommodates a plurality of cassettes C1 through C4 respectively at a plurality of accommodation positions which are provided in the form of stages. The cassettes C1 through C4 each have press plates loaded thereon. The user supplements an appropriate press plate in accordance with each of the cassettes C1 through C4 in the cassette accommodation apparatus 510. A cassette having press plates loaded thereon is supplied from the cassette accommodation apparatus 510 to a press plate supply apparatus 500 as follows. First, the cassette is inserted into a lift section 501 provided in the press plate supply apparatus 500, as follows. The lift-section 501 is movable vertically in the directions of arrow Y shown in FIG. 13. The lift section 501 moves to the height of the position of the cassette having the press plates loaded thereon in the cassette accommodation apparatus 510, and the cassette is inserted into the lift section 501 by a horizontal moving mechanism (not shown) for moving the cassette horizontally, in the direction of arrow X1 in FIG. 13. The press plate supply apparatus 500 moves the cassette inserted into the lift section 501 to a press plate transportation position, and then transports the press plates loaded on the cassette at the press plate transportation position to the image recording apparatus.

When the cassette in the press plate supply apparatus 500 becomes out of press plates or when a different type of press plates need to be supplied to the image recording apparatus, the lift section 501 moves to a cassette retraction position (corresponding to the stage where there is no cassette in the cassette accommodation apparatus 510) in the press plate supply apparatus 500, and the cassette in the lift section 501 is retracted to the cassette accommodation apparatus 510 by the horizontal moving mechanism in the direction of arrow X2 in FIG. 13. Then, the lift section 501 moves to the height of the position of a cassette, having the press plates to be transported next, in the cassette accommodation apparatus 510, and the cassette is inserted into the lift section 501 by the horizontal moving mechanism in the direction of arrow X1 in FIG. 13. The press plate supply apparatus 500 moves the cassette inserted into the lift section 501 to the press plate transportation position, and then transports the new press plates loaded on the cassette at the press plate transportation position to the image recording apparatus.

As an example, a procedure of replacing the cassette C1 located at the press plate transportation position in the press plate supply apparatus 500 with the cassette C4 will be described. First, the lift section 501 having the cassette C1 therein moves from the press plate transportation position to a cassette retraction position L1 in the press plate supply apparatus 500. Thus, the cassette C1 is located at the cassette retraction position L1. Next, the cassette C1 is moved from the cassette retraction position L1 horizontally in the direction of arrow X2 to the cassette accommodation apparatus 510 by the horizontal moving mechanism. When the cassette C1 is completely retracted from the lift section 501, the lift section 501 moves from the cassette retraction position L1 in the direction of arrow Y to the height at which the cassette C4 is accommodated in the cassette accommodation apparatus 510 (cassette retraction position L4). Then, the cassette C4 is moved from the cassette accommodation apparatus 510 to the cassette retraction position L4 horizontally in the direction of arrow X1 by the horizontal moving mechanism, and is inserted into the lift section 501. The lift section 501 having the cassette C4 therein moves from the cassette retraction position L4 to the press plate transportation position. Thus, the cassette C4 is located at the press plate transportation position.

As described above, for replacing a cassette in the press plate supply apparatus with another cassette, the cassette located in the lift section is first retracted into the cassette accommodation apparatus and then the new cassette is inserted into the lift section. Therefore, the press plate supply apparatus requires a long time for the cassette replacement operation, which is at least a sum of the time for retracting the cassette and the time for inserting the cassette. Moreover, during the cassette replacement operation, press plates cannot be transported from the press plate supply apparatus to the image recording apparatus. In the case where the cassette replacement operation requires a long time, the press plate supply apparatus is at a stop for a long time.

SUMMARY OF THE INVENTION

Therefore, an object of the present invention is to provide an image recording material supply apparatus and method, capable of performing a replacement operation of cassettes which accommodate image recording materials within a short time.

The present invention has the following features to attain the object mentioned above.

A first aspect of the present invention is directed to an image recording material supply apparatus for transporting and supplying an image recording material at an uppermost position among image recording materials loaded on a cassette. The image recording material supply apparatus comprises a transportation mechanism, a cassette accommodation section, a cassette moving mechanism, and a control section. The transportation mechanism transports an image recording material at an uppermost position among image recording materials loaded on a cassette located at a predetermined image recording material transportation position. The cassette accommodation section accommodates a plurality of cassettes. The cassette moving mechanism moves the cassette between the cassette accommodation section and the image recording material transportation position. The control section controls an operation of the cassette moving mechanism of moving the cassette. The control section controls the operation of the cassette moving mechanism to perform a moving operation of retracting the cassette located at the image recording material transportation position to the cassette accommodation section, concurrently with a moving operation of supplying another cassette accommodated in the cassette accommodation section to the image recording material transportation position.

In a second aspect based on the first aspect, the transportation mechanism transports an image recording material at an uppermost position among image recording materials loaded on a cassette located at either one of a first image recording material transportation position and a second image recording material transportation position which are different from each other in a vertical direction. The cassette accommodation section has a first cassette accommodation position and a second cassette accommodation position as positions at which the cassettes are to be accommodated, the first cassette accommodation position and the second cassette accommodation position being respectively horizontal with the first image recording material transportation position and the second image recording material transportation position. The cassette moving mechanism comprises a first sliding movement mechanism and a second sliding movement mechanism. The first sliding movement mechanism horizontally moves the cassette back and forth between the first image recording material transportation position and the first cassette accommodation position. The second sliding movement mechanism horizontally moves the cassette back and forth between the second image recording material transportation position and the second cassette accommodation position. The control section controls such that: an operation of the first sliding movement mechanism of horizontally moving the cassette to the first cassette accommodation position is performed in parallel with an operation of the second sliding movement mechanism of horizontally moving another cassette to the second image recording material transportation position; and an operation of the second sliding movement mechanism of horizontally moving the cassette to the second cassette accommodation position is performed in parallel with an operation of the first sliding movement mechanism of horizontally moving another cassette to the first image recording material transportation position.

In a third aspect based on the first aspect, the cassette accommodation section has a first cassette accommodation position and a second cassette accommodation position as positions at which the cassettes are to be accommodated, the first cassette accommodation position and the second cassette accommodation position being provided on both sides of, and horizontal with, the image recording material transportation position. The cassette moving mechanism comprises a first sliding movement mechanism and a second sliding movement mechanism. The first sliding movement mechanism horizontally moves the cassette back and forth between the image recording material transportation position and the first cassette accommodation position. The second sliding movement mechanism horizontally moves the cassette back and forth between the image recording material transportation position and the second cassette accommodation position. The control section controls such that: an operation of the first sliding movement mechanism of horizontally moving the cassette to the first cassette accommodation position is performed in parallel with an operation of the second sliding movement mechanism of horizontally moving another cassette to the image recording material transportation position; and an operation of the second sliding movement mechanism of horizontally moving the cassette to the second cassette accommodation position is performed in parallel with an operation of the first sliding movement mechanism of horizontally moving another cassette to the image recording material transportation position.

In a fourth aspect based on the first aspect, the transportation mechanism transports an image recording material at an uppermost position among image recording materials loaded on a cassette located at either one of a first image recording material transportation position and a second image recording material transportation position which are different from each other in a vertical direction. The cassette accommodation section has a first cassette accommodation position, a second cassette accommodation position, a third cassette accommodation position, and a fourth cassette accommodation position as positions at which the cassettes are to be accommodated, the first cassette accommodation position and the second cassette accommodation position being provided on both sides of, and horizontal with, the first image recording material transportation position, and the third cassette accommodation position and the fourth cassette accommodation position being provided on both sides of, and horizontal with, the second image recording material transportation position. The cassette moving mechanism comprises a first sliding movement mechanism, a second sliding movement mechanism, a third sliding movement mechanism, and a fourth sliding movement mechanism. The first sliding movement mechanism horizontally moves the cassette back and forth between the first image recording material transportation position and the first cassette accommodation position. The second sliding movement mechanism horizontally moves the cassette back and forth between the first image recording material transportation position and the second cassette accommodation position. The third sliding movement mechanism horizontally moves the cassette back and forth between the second image recording material transportation position and the third cassette accommodation position. The fourth sliding movement mechanism horizontally moves the cassette back and forth between the second image recording material transportation position and the fourth cassette accommodation position. The control section controls such that an operation of the sliding movement mechanism corresponding to the cassette located at the first or second image recording material transportation position of horizontally moving the cassette to the corresponding cassette accommodation section is performed in parallel with an operation of another one of the sliding movement mechanisms of horizontally moving another cassette to the first or second image recording material transportation position.

A fifth aspect of the present invention is directed to an image recording material supply method for transporting and supplying an image recording material at an uppermost position among image recording materials loaded on a cassette. The image recording material supply method comprises the steps of accommodating a plurality of cassettes in advance; transporting an image recording material at an uppermost position among image recording materials loaded on a cassette located at a predetermined image recording material transportation position; and for replacing the cassette located at the image recording material transportation position, retracting the cassette located at the image recording material transportation position to a cassette accommodation position, concurrently with moving another cassette accommodated in advance to the image recording material transportation position.

In a sixth aspect based on the fifth aspect, the method comprises the steps of transporting an image recording material at an uppermost position among image recording materials loaded on a cassette located at either one of a first image recording material transportation position and a second image recording material transportation position which are different from each other in a vertical direction; accommodating, in advance, the cassettes at a first cassette accommodation position and a second cassette accommodation position provided respectively horizontal with the first image recording material transportation position and the second image recording material transportation position; for replacing the cassette located at the first image recording material transportation position, retracting the cassette located at the first image recording material transportation position to the first cassette accommodation position, concurrently with moving another cassette accommodated at the second cassette accommodation position to the second image recording material transportation position; and for replacing the cassette located at the second image recording material transportation position, retracting the cassette located at the second image recording material transportation position to the second cassette accommodation position, concurrently with moving another cassette accommodated at the first cassette accommodation position to the first image recording material transportation position.

In a seventh aspect based on the fifth aspect, the method comprises the steps of accommodating, in advance, the cassettes at a first cassette accommodation position and a second cassette accommodation position provided on both sides of, and horizontal with, the image recording material transportation position; and for replacing the cassette located at the image recording material transportation position, retracting the cassette located at the image recording material transportation position to the first cassette accommodation position, concurrently with moving another cassette accommodated at the second cassette accommodation position to the image recording material transportation position, or retracting the cassette located at the image recording material transportation position to the second cassette accommodation position, concurrently with moving another cassette accommodated at the first cassette accommodation position to the image recording material transportation position.

In an eighth aspect based on the fifth aspect, the method comprises the steps of transporting an image recording material at an uppermost position among image recording materials loaded on a cassette located at either one of a first image recording material transportation position and a second image recording material transportation position which are different from each other in a vertical direction; accommodating, in advance, the cassettes at a first cassette accommodation position and a second cassette accommodation position provided on both sides of, and horizontal with, the first image recording material transportation position, and at a third cassette accommodation position and a fourth cassette accommodation position provided on both sides of, and horizontal with, the second image recording material transportation position; and for replacing the cassette located at the first or second image recording material transportation position, retracting the cassette to one of the first, second, third and fourth cassette accommodation positions, concurrently with moving another cassette accommodated at one of the cassette accommodation positions, which is different from the cassette accommodation position to which the cassette is retracted, to the first or second image recording material transportation position.

According to the first aspect, for replacing the cassette located at the image recording material transportation position, an operation of retracting the cassette to a cassette accommodation section is performed in parallel with an operation of inserting a new cassette from the cassette accommodation section to the image recording material transportation position. Therefore, the time required by the image recording material supply apparatus for the cassette replacement operation is either the time for retracting the cassette or the time for inserting the cassette. In other words, although the image recording materials cannot be transported from the image recording material supply apparatus during the cassette replacement operation, the time in which the image recording material supply apparatus must stop the transportation of the image recording materials can be shortened. In addition, since the image recording material supply apparatus does not require the mechanism for vertically moving the cassette, the cost of the image recording material supply apparatus is reduced.

According to the second aspect, the present invention can be realized with a structure in which one cassette accommodation section for accommodating cassettes stacked in a vertical direction is provided on one side of the transportation mechanism.

According to the third aspect, cassette accommodation sections each accommodating a single cassette are provided on both sides of the transportation mechanism. Since the transportation mechanism transports an image recording material in accordance with a single transportation position, the structure of the transportation mechanism can be simplified.

According to the fourth aspect, cassette accommodation sections each accommodating cassettes stacked in a vertical direction are provided on both sides of the transportation mechanism. The types of usable cassettes are diversified and the variation of the manner of horizontally moving the cassettes becomes wider, and it is possible to optimize the procedure in accordance with the form of work.

An image recording material supply method according to the present invention provides substantially the same effects as those of the image recording material supply apparatus described above.

These and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
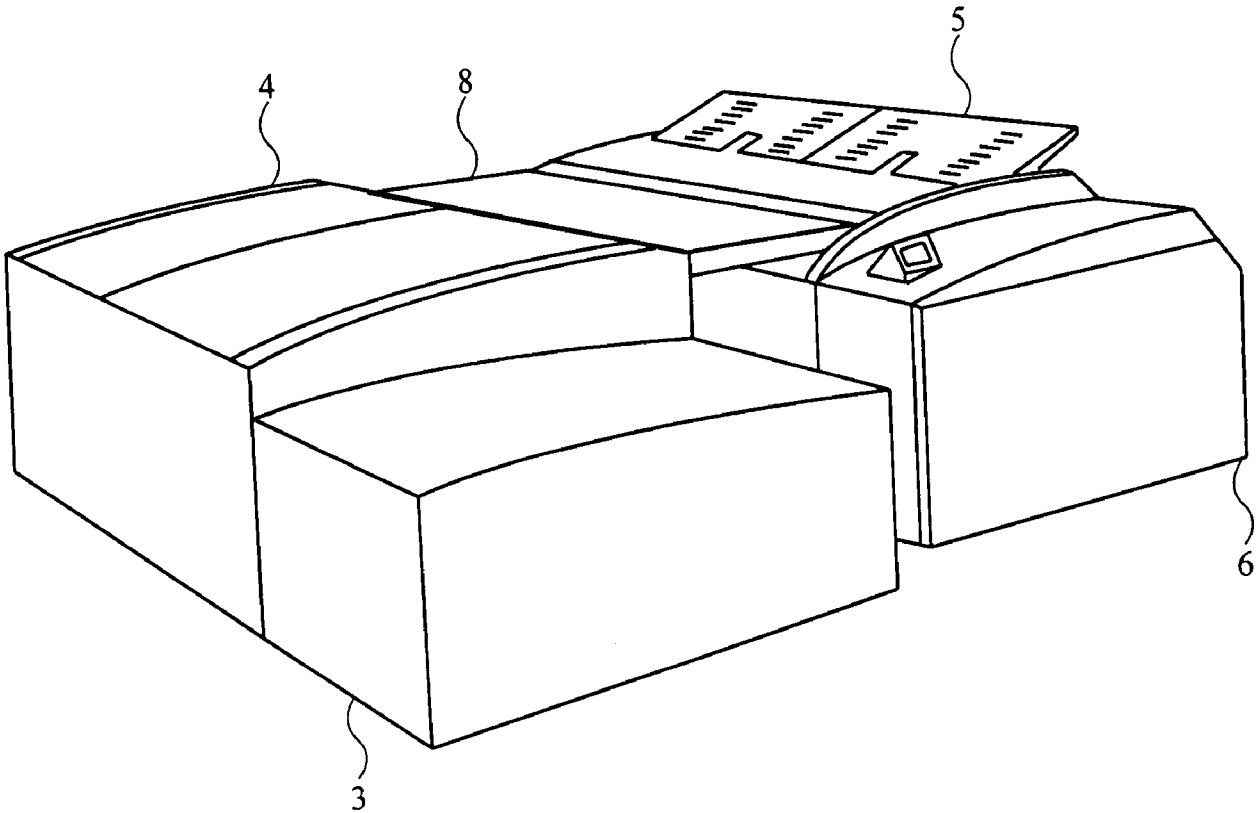
FIG. 1 is an isometric view of an image recording system including an image recording material supply apparatus according to Embodiment 1 of the present invention.

An image recording material supply apparatus according to Embodiment 1 of the present invention will be described. The image recording material supplied here is a sheet-form material such as a press plate, for example, a PS plate (Presensitized Plate) or a thermal plate, or a film. As an example of the image recording material supply apparatus, an automatic loader (automatic press plate supply apparatus) for automatically supplying a press plate will be used. FIG. 1 is an isometric view of an image recording system including the automatic loader, FIG. 2 is a schematic side view thereof, and FIG. 3 is a schematic plan view thereof.

Figure 2:
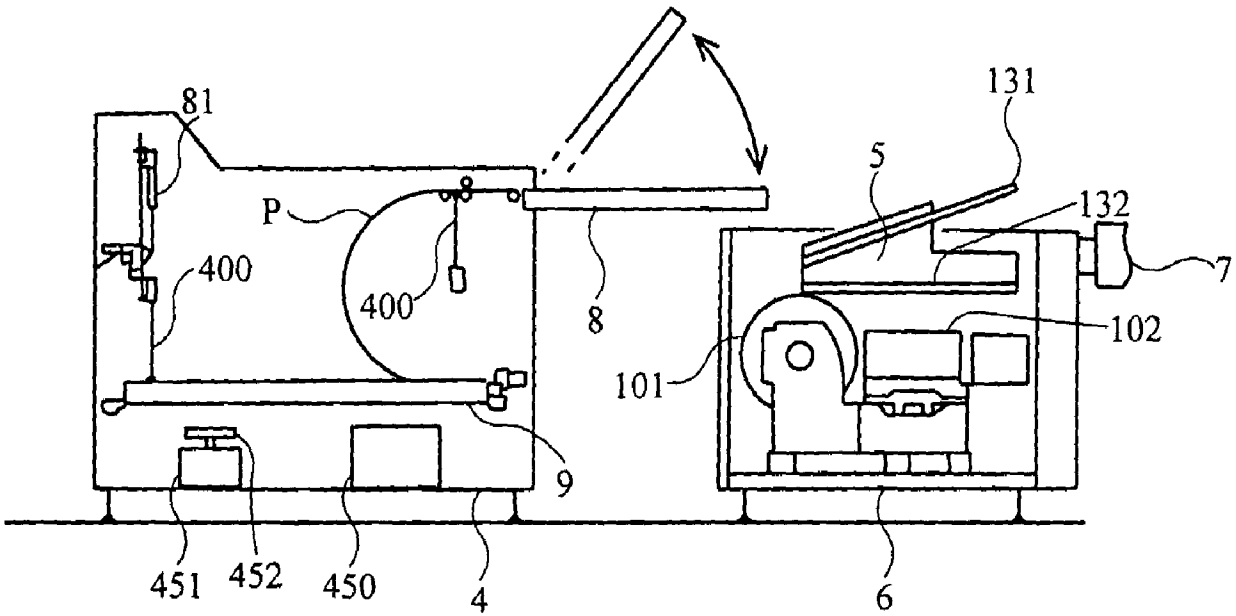
FIG. 2 is a schematic side view of the image recording system shown in FIG. 1.
Figure 3:
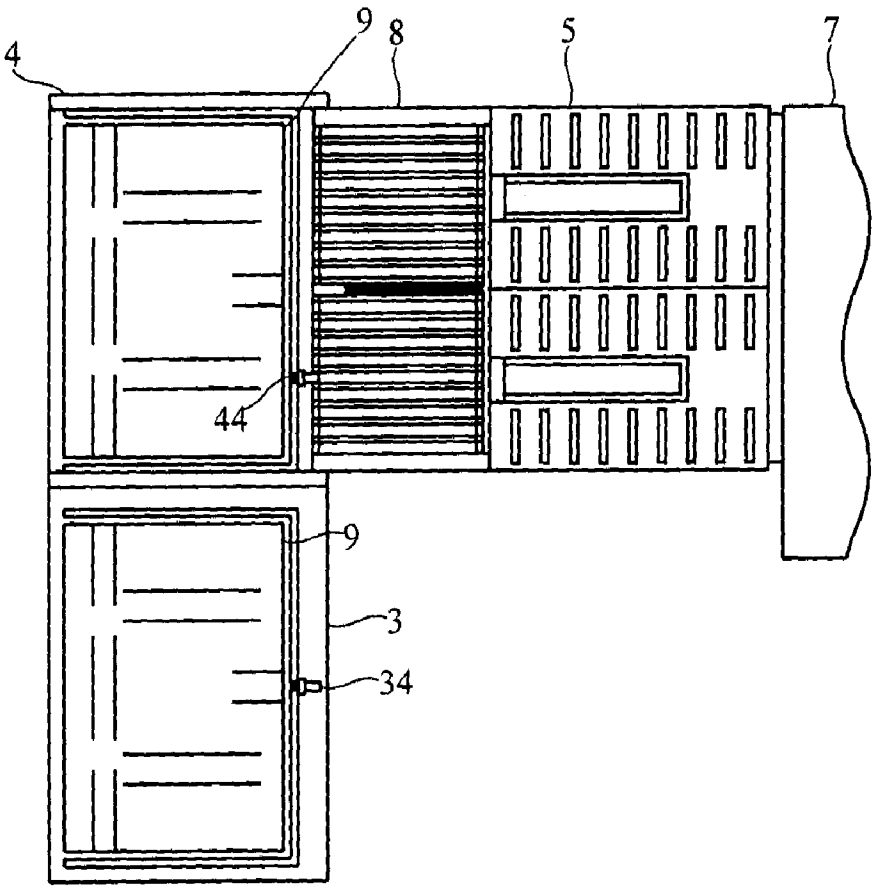
FIG. 3 is a schematic plan view of the image recording system shown in FIG. 1.

In FIGS. 1 through 3, the automatic loader in the image recording system supplies a press plate P loaded on a cassette 9 to an image recording section 6. The image recording system includes a cassette accommodation section 3 accommodating a plurality of cassettes 9 stacked in a vertical direction, an automatic loader section 4 for removing a press plate P from the cassette 9 located therein and transporting the press plate P, a feeding and discharge tray section 5 including a plate feeding tray 131 and a plate discharge tray 132, a conveyor section 8, the image recording section 6 for recording an image on the press plate P, and a transportation mechanism 7 for transporting the press plate P having the image recorded thereon by the image recording section 6 to a later-stage automatic development apparatus (not shown). The image recording material supply apparatus according to this embodiment includes the automatic loader section 4 and the cassette accommodation section 3.

The conveyor section 8 is for transporting the press plate P from the automatic loader section 4 to the feeding and discharge tray section 5. As represented with the two-dot chain line in FIG. 2, the conveyor section 8 is structured to be pivotable upward around one end thereof as the center in order to improve the ease of maintenance of the entire image recording system.

In this image recording system, the plurality of cassettes 9 are accommodated in a stacked manner in the vertical direction in the cassette accommodation section 3. For transporting a press plate P in a cassette 9 to the image recording section 6, the cassette 9 accommodated in the cassette accommodation section 3 is moved to the automatic loader section 4 by a sliding mechanism (FIG. 3 only shows motors 34 and 44 thereof) which is controlled by, for example, an electric component control section 450 described below.

As shown in FIG. 3, by opening the top of the cassette accommodation section 3, the user can supplement a new press plate P to the cassette 9 located in the cassette accommodation section 3 when necessary. The press plate P is, for example, a PS plate and includes a support layer and an image recording layer. The press plate P is accommodated in the cassette 9 in the state where the image recording layer thereof is at the lower surface. A plurality of press plates P may be supplied to the cassette 9 in the state where a plurality of interleaves S are stacked alternately therewith, in order to prevent friction between the press plates P.

The automatic loader section 4 transports a press plate P loaded on the cassette 9 located in the automatic loader section 4 to the image recording section 6. The automatic loader section 4 includes a press plate transportation mechanism 400 having a movable arm with an adsorption pad for adsorbing a press plate P, an interleaf transportation mechanism 81 also having an adsorption pad, a vacuum pump 451 communicated and connected to the adsorption pads of the press plate transportation mechanism 400 and the interleaf transportation mechanism 81 via an electromagnetic valve 452 and a hose (not shown), and the electric component control section 450 for controlling these mechanisms. The support layer of the press plate P loaded on the cassette 9 is adsorbed and thus held by the adsorption pad of the press plate transportation mechanism 400. By the movable arm moving while pivoting in that state, the press plate P is inverted upside down. Then, as shown in FIG. 2, the press plate P is transported with a leading end thereof directed toward the conveyor section 8. The press plate P, when arriving at the conveyor section 8, is transported to the plate feeding tray 131 in the feed and discharge tray section 5 in the state where the support layer is at the lower surface.

In the case where a plurality of press plates P and a plurality of interleaves S are alternately loaded on the cassette 9, the automatic loader section 4 includes the interleaf transportation mechanism 81 having a movable adsorption plate or pad for adsorbing an interleaf S, in order to discharge the interleaf S. Each time a press plate P is removed from the cassette 9 by the movable arm of the press plate transportation mechanism 400, the interleaf transportation mechanism 81 adsorbs and thus secures the interleaf S by the adsorption pad and moves the adsorption pad to a predetermined position in this state. Thus, the interleaf S is discharged outside the automatic loader section 4.

The image recording section 6 includes a cylindrical recording drum 101 and a recording head 102. The recording drum 101 is to have a press plate P attached around an outer peripheral surface thereof. The recording drum 101 is rotatable around an cylindrical axis thereof by a driving force of a motor (not shown). The recording head 102 is for recording an image on the press plate P attached to the outer peripheral surface of the recording drum 101. The recording head 102 includes a plurality of light emitting elements and has a structure for radiating optical beams from the plurality of light emitting elements which are modified in correspondence with an image signal or the like.

The press plate P which is placed on the plate feeding tray 131 is transported to the recording drum 101 provided in the image recording section 6. The press plate P is then attached to the outer peripheral surface of the recording drum 101 in the state where the image recording layer is at the outer surface. While being carried on the recording drum 101 which is rotating around the cylindrical axis thereof, the image recording layer of the press plate P is irradiated with optical beams, modified in accordance with the image signal or the like, from the recording head 102. When the image recording on the press plate P is completed, the press plate P is discharged to the transportation mechanism 7 via the plate discharge tray 132.

Figure 4:
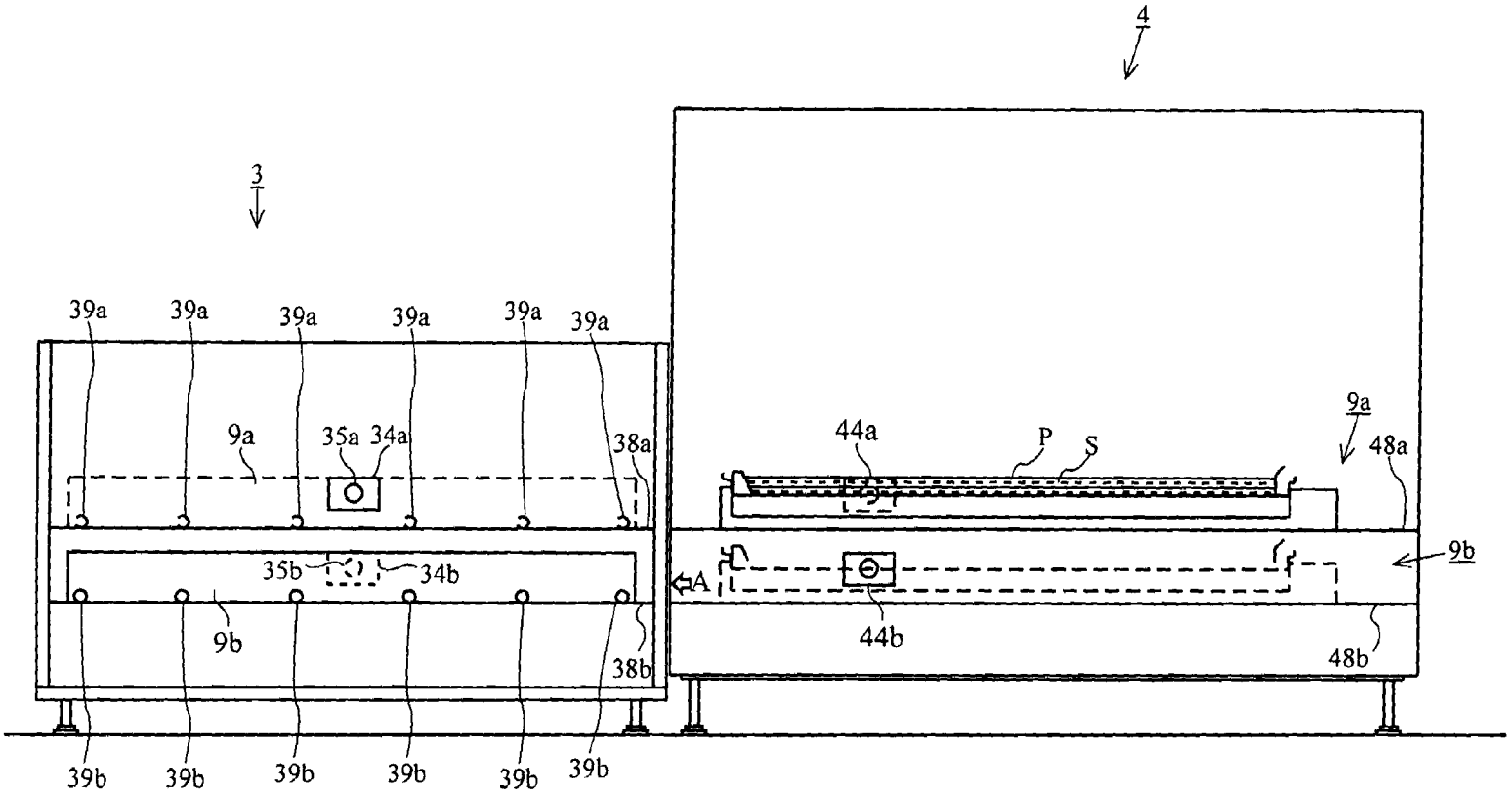
FIG. 4 is a side view showing a structure of a cassette accommodation section 3 and an automatic loader section 4 which are shown in FIG. 3, and of a sliding mechanism provided throughout the cassette accommodation section 3 and the automatic loader section 4.
Figure 5:
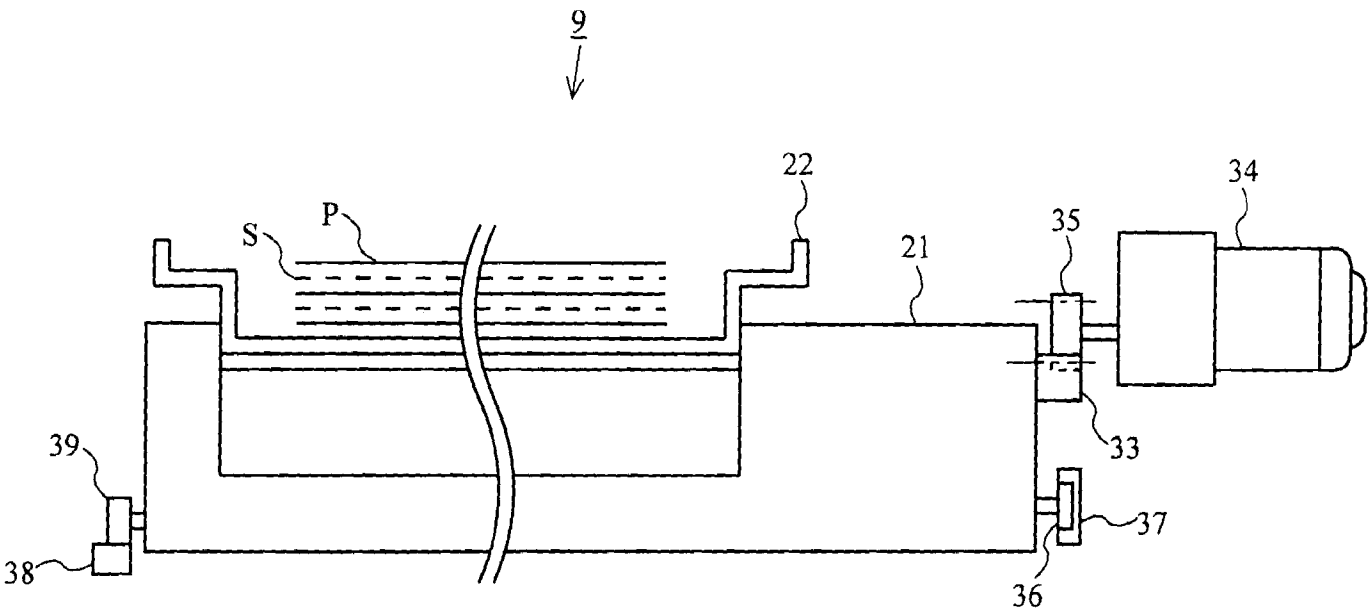
FIG. 5 is an enlarged view of principal parts, showing a relationship between cassettes 9 in the cassette accommodation section 3 and the sliding mechanism shown in FIG. 4.

Hereinafter, with reference to FIG. 4 and FIG. 5, a structure of the cassette accommodation section 3 and the automatic loader section 4 will be described. FIG. 4 is a side view showing a structure of the cassette accommodation section 3, the automatic loader section 4, and a sliding mechanism provided throughout the cassette accommodation section 3 and the automatic loader section 4. FIG. 5 is an enlarged view of principal parts, showing a relationship between the cassettes 9 in the cassette accommodation section 3 and the sliding mechanism, which is seen in the direction of arrow A in FIG. 4.

In FIG. 4, a cassette 9 is structured to be movable back and forth between the cassette accommodation section 3 and the automatic loader section 4 by the sliding mechanism. In the automatic loader section 4, the side plate of the cassette 9 is not shown in order to show the press plate P and the interleaf S loaded thereon. Although a plurality of cassettes 9 are actually stacked in the cassette accommodation section 3, a specific description will be given below using two cassettes 9*a* and 9*b* located in the cassette accommodation section 3 as representative cassettes. The cassettes 9*a* and 9*b*, including the elements thereof, will be sometimes collectively referred to as the "cassettes 9" without "a" or "b" in the reference numerals.

As shown in FIG. 4 and FIG. 5, each cassette 9 includes an outer tray 21 and an inner tray 22 provided inside the outer tray 21. The press plates P and the interleaves S are alternately stacked inside the inner tray 22. Side plates on one side of the outer trays 21*a* and 21*b* of the cassettes 9*a* and 9*b* are respectively provided with a plurality of rollers 39*a* and 39*b*. The plurality of rollers 39*a* and 39*b* are respectively supported by support rails 38*a* and 38*b* which are horizontally provided in the cassette accommodation section 3. The side plates on the other side of the outer trays 21*a* and 21*b* of the cassettes 9*a* and 9*b* are also respectively provided with a plurality of rollers 36*a* and 36*b*. The plurality of rollers 36*a* and 36*b* are respectively engaged with guide members 37*a* and 37*b* provided in the cassette accommodation section 3, parallel to the support rails 38*a* and 38*b*. In other words, the plurality of rollers 36*a*, 36*b*, 39*a* and 39*b* are respectively supported by the guide members 37*a*, 37*b* and the support rails 38*a* and 38*b*. By this structure, the cassettes 9*a* and 9*b* are stacked in the cassette accommodation section 3 in the vertical direction in a horizontally movable state (hereinafter, the movement in the horizontal direction will be referred to as the "sliding movement", and the horizontally movable direction will be referred to as the "sliding-movable direction").

In the automatic loader section 4, support rails 48*a* and 48*b* are extended in the sliding-movable direction at a height corresponding to the support rails 38*a* and 38*b* in the cassette accommodation section 3. Similarly, in the automatic loader section 4, guide members (not shown) are extended in the sliding-movable direction at a height corresponding to the guide members 37*a* and 37*b* in the cassette accommodation section 3. When the cassettes 9*a* and 9*b* have reached the automatic loader section 4, the plurality of rollers 39*a* and 39*b* are respectively supported by the support rails 48*a* and 48*b*, and the plurality of rollers 36*a* and 36*b* are respectively supported by the guide members in the automatic loader section 4.

The side plates on the other side of the outer trays 21*a* and 21*b* of the cassettes 9*a* and 9*b* are also provided respectively with racks 33*a* and 33*b*, which are extended over the entire length of the side plates in the sliding-movable direction. The racks 33*a* and 33*b* can be respectively in mesh with pinions 35*a* and 35*b*, which are respectively driven to rotate by motors 34*a* and 34*b* provided in the cassette accommodation section 3 respectively for the support rails 38*a* and 38*b*. The racks 33*a* and 33*b* can also be respectively in mesh with pinions which are driven to rotate by motors 44*a* and 44*b* provided in the automatic loader section 4 respectively for the support rails 48*a* and 48*b*. Accordingly, the cassettes 9*a* and 9*b* are driven by the motors 34*a*, 34*b*, 44*a* and 44*b* to move in the sliding-movable direction between the cassette accommodation section 3 and the automatic loader section 4 along the support rails 38*a*, 38*b*, 48*a* and 48*b*.

For example, in the state where the cassette 9*a* is accommodated in the cassette accommodation section 3, when the motor 34*a* drives the pinion 35*a* to rotate and the motor 44*a* in the automatic loader section 4 drives the corresponding pinion to rotate, the cassette 9*a* is first driven by the pinion 35*a* via the rack 33*a* and is also guided by the guide member 37*a* and the support rail 38*a* in the cassette accommodation section 3 to start moving from the cassette accommodation section 3 to the automatic loader section 4.

When a leading end of the cassette 9*a* is inserted into the automatic loader section 4, the cassette 9*a* is guided to the guide member and the support rail 48*a* in the automatic loader section 4. Then, the rack 33*a* of the cassette 9*a* goes into mesh with the pinion of the motor 44*a* and thus is driven by the pinion. After this, the rack 33*a* is released from the engagement with the pinion 35*a* of the cassette accommodation section 3. After the disengagement of the rack 33 from the pinion 35*a*, the cassette 9*a* is driven by the pinion in the automatic loader section 4 and moves to the position shown in FIG. 4.

For retracting the cassette 9*a* to the cassette accommodation section 3, the rotation directions of the pinions by the motor 34*a* and 44*a* are reversed. Thus, the cassette 9*a* moves in the opposite direction from the direction described above. The cassette 9*b* moves in the sliding-movable direction in substantially the same manner as the cassette 9*a*. FIG. 4 shows a state where the movement of the upper cassette 9*a* from the cassette accommodation section 3 to the automatic loader section 4 has been completed. In the automatic loader section 4, both the cassettes 9*a* and 9*b* can be concurrently located. The automatic loader section 4 has a plurality of press plate transportation positions as can be seen from the cassette 9*a* represented with the solid line and the cassette 9*b* represented with the dashed line in FIG. 4. The driving states of the motors 34*a*, 34*b*, 44*a* and 44*b* are controlled by the electric component control section 450.

Figure 6:
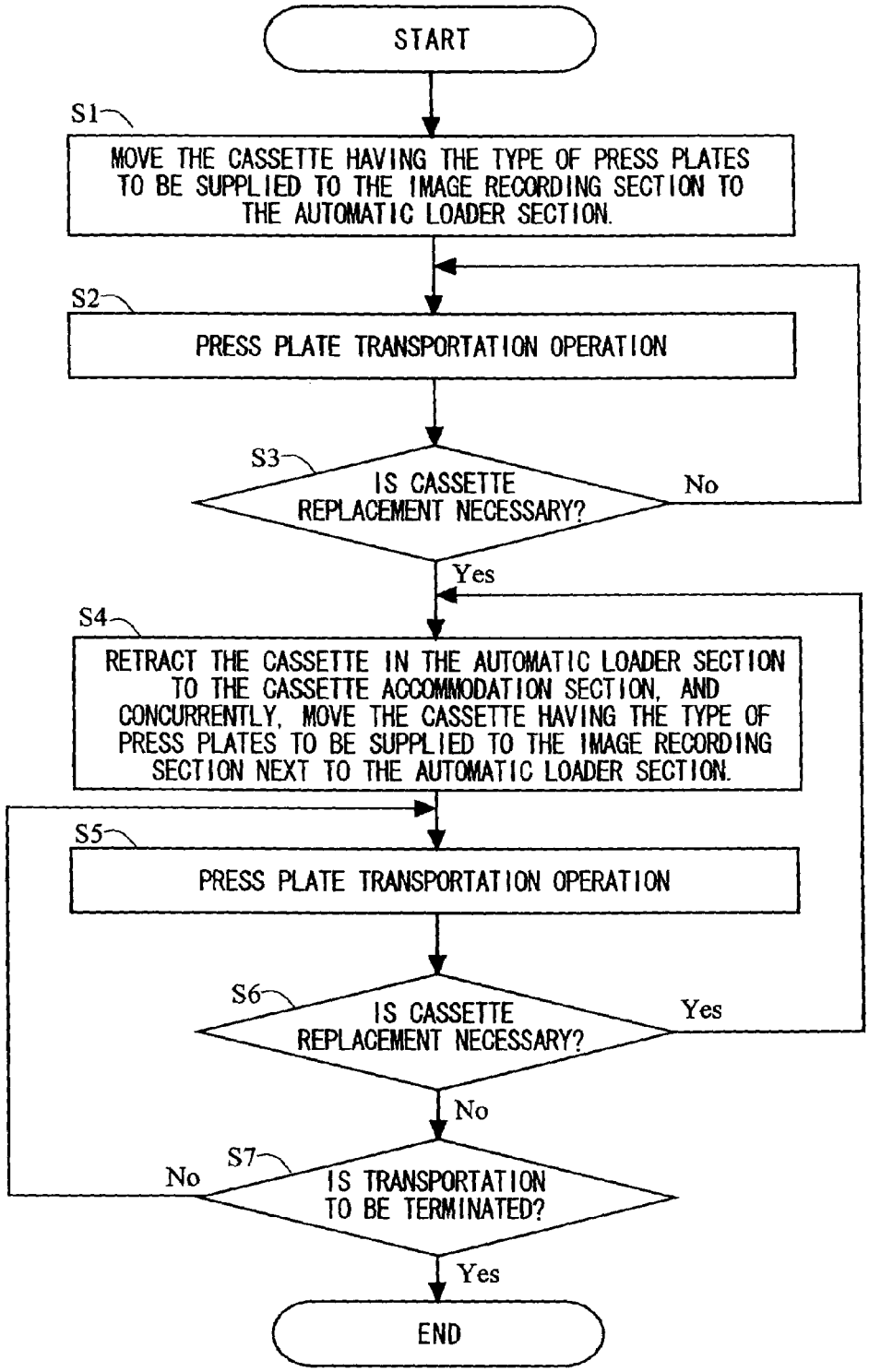
FIG. 6 is a flowchart showing an operation of the electric component control section 450 of horizontally moving the cassettes 9.

With reference to FIG. 6, an operation of horizontally moving a plurality of cassette 9 between the automatic loader section 4 and the cassette accommodation section 3 will be described. FIG. 6 is a flowchart showing the operation of horizontally moving the cassettes 9 by the electric component control section 450.

As shown in FIG. 6, the electric component control section 450 selects, from the cassette accommodation section 3, a cassette 9 having the type of press plate P to be supplied to the image recording section 6, and horizontally moves the cassette 9 to the automatic loader section 4 (step S1). Specifically, the electric component control section 450 moves the selected cassette 9 in the sliding-movable direction by rotating the motors 34 and 44 corresponding to the cassette 9 to be horizontally moved, in such a direction that the cassette 9 is inserted into the automatic loader section 4.

When the movement of the cassette 9 in step S1 is completed, the electric component control section 450 performs a press plate transportation operation of transporting a press plate P loaded on the cassette 9 to the image recording section 6 (step S2). This operation is continued until the cassette 9 is replaced with another cassette (step S3). The details of the press plate transportation operation will be described later. The cassette replacement is necessary, for example, when the cassette 9 in the automatic loader section 4 becomes out of press plates, or when a different type of press plates need to be supplied to the image recording section 6. In other words, press plates which are scheduled to be transported to the image recording section 6 next can be supplemented to the cassette 9 located in the cassette accommodation section 3. For example, the same type of press plates as those which are currently being supplied can be supplemented for the case where the cassette 9 in the automatic loader section 4 becomes out of press plates. Alternatively, a different type of press plates which are scheduled to be supplied next can be supplemented.

When the cassette replacement is necessary (Yes in step S3), the electric component control section 450 retracts the cassette 9 located in the automatic loader section 4 to the cassette accommodation section 3, and concurrently, horizontally moves the cassette 9 in the cassette accommodation section 3 to the automatic loader section 4 (step S4). Specifically, the electric component control section 450 retracts the cassette 9 to the cassette accommodation section 3 by rotating the motors 34 and 44 corresponding to the cassette 9 to be retracted, in such a direction that the cassette 9 is retracted to the cassette accommodation section 3, and concurrently, moves the cassette 9 in the sliding-movable direction by rotating the motors 34 and 44 corresponding to the cassette 9 to be horizontally moved to the automatic loader section 4, in such a direction that the cassette 9 is inserted into the automatic loader section 4.

When the movement of the cassette 9 in step S4 is completed, the electric component control section 450 performs a press plate transportation operation of transporting a press plate P loaded on the cassette 9 to the image recording section 6 (step S5). This operation is also continued until the next time when the cassette replacement is necessary (step S6) or until the transportation of the press plates is terminated (step S7). This press plate transportation operation is substantially the same as the press plate transportation operation performed in step S2, and will be described later in detail. The cassette replacement in step S5 is also performed, for example, when the cassette 9 in the automatic loader section 4 becomes out of press plates, or when a different type of press plates need to be supplied to the image recording section 6. In other words, press plates which are scheduled to be transported to the image recording section 6 next can be supplemented to the cassette 9 retracted to the cassette accommodation section 3. For example, the same type of press plates as those which are currently being supplied can be supplemented for the case where the cassette 9 in the automatic loader section 4 becomes out of press plates. Alternatively, a different type of press plates which are to be supplied next can be supplemented.

When the cassette replacement is necessary (Yes in step S6), the electric component control section 450 returns to step S4 and repeats the processing. When the transportation of the press plates to the image recording section 6 is to be terminated, the processing shown in this flowchart is terminated.

With reference to FIGS. 7 through 10, a schematic structure and a transportation operation of the press plate transportation mechanism 400 for transporting a press plate P from the cassette 9 located at the press plate transportation position toward the conveyor section 8 will be described. FIGS. 7 through 10 are views showing an overall operation of the press plate transportation mechanism 400 seen from a side surface of the automatic loader section 4. The automatic loader section 4 has a plurality of press plate transportation positions as can be seen from the cassette 9*a* represented with the solid line and the cassette 9*b* represented with the dashed line in FIG. 4. Accordingly, extendable pad rods 403 are used in the press plate transportation mechanism 400. In the following description, the press plate transportation position corresponding to the position of the cassette 9*a* will be referred to as a "first press plate transportation position" and the press plate transportation position corresponding to the position of the cassette 9*b* will be referred to as a "second press plate transportation position", for the sake of convenience. Here, a specific description will be given using, as an example, the second press plate transportation position to which the selected cassette 9*b* has reached by the sliding movement.

In FIGS. 7 through 10, the press plate transportation mechanism 400, for transporting a press plate P from the cassette 9 which has moved to the first or second press plate transportation position toward the conveyor section 8, includes a linear bush holder 407, which is driven by an endless synchronization belt 442 pivotable by a driving force of a loader moving motor 440 and runs along a slide rail 444. The synchronization belt 442 is pivotably extended between and along two pairs of driving pulleys 443 and 448. The driving force of the loader moving motor 440 is conveyed to the synchronization belt 442 by the rotation of one of the driving pulley pair 448, via a belt 441. The driving force of the loader moving motor 440 is conveyed to the other of the driving pulley pair 448 via a horizontal shaft (not shown), which is fixedly connected at two ends thereof to the two driving pulleys 448. The pair of driving pulleys 448 rotate in the same phase by the loader moving motor 440. A connection section 408 is fixedly provided on the linear bush holder 407. By the connection section 408 holding the synchronization belt 442, the linear bush holder 407 receives the driving force of the synchronization belt 442. On the linear bush holder 407, a decelerator 405 is provided. The decelerator 405 has a loader inverting pinion gear 406 which is in mesh with a rack rail 445 provided parallel to the slide rail 444. On the decelerator 405, a plurality of pad rods 403 are provided via a connecting shaft and a loader base (neither is shown). The connecting shaft, the loader base, and the pad rods 403 are provided so as to be capable of inverting a press plate P around the axis of the connecting shaft at a rotation rate which is lowered by the decelerator 405.

A leading end of each pad rod 403 has a pair of support plates 402 provided thereon. The support plates 402 have a plurality of adsorption pads 401 provided thereon for adsorbing and thus holding a press plate P. The leading end of each pad rod 403 also has a support roller 404 provided thereon. When the press plate P is to be transported, the support roller 404 supports a leading end of the press plate P from below. The loader base is connected to an arm 409 having a support roller 410 at a tip thereof. The support roller 410 is for supporting a central area or the vicinity thereof of the press plate P from below. The adsorption pad 401 is supplied with a negative pressure from the vacuum pump 451 which is communicated and connected to the adsorption pad 401 via the electromagnetic valve 452 and the hose (not shown).

On the loader base, a pad rod moving motor 411 for moving the pad rods 403 up and down is provided. The pad rod moving motor 411 moves each pad rod 403 with respect to the loader base, such that the distance in the longitudinal direction (stroke length) of the pad rod 403 from the adsorption pad 401 provided at the tip thereof to the loader base is changed. Namely, the pad rod moving motor 411 moves the adsorption pad 401 up and down by substantially extending or shortening the pad rod 403, as follows.

Figure 7:
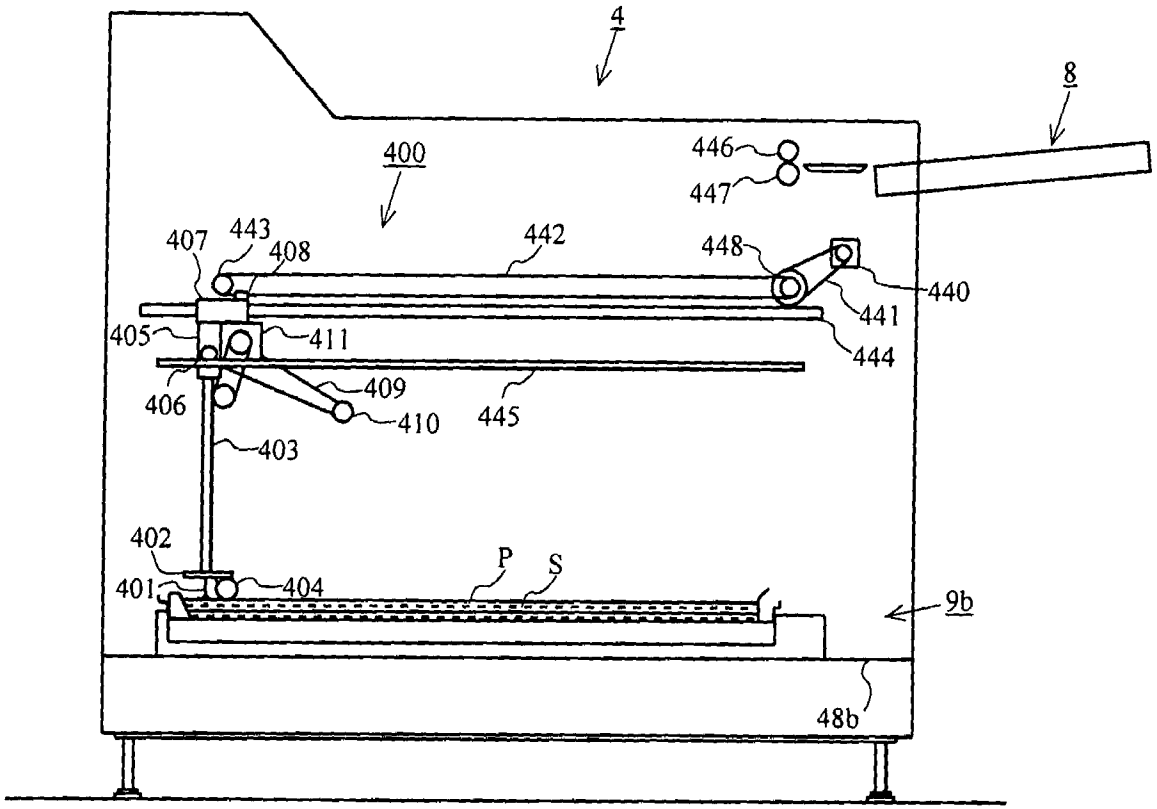
FIG. 7 is a view showing an overall operation of a press plate transportation mechanism 400, which is seen from a side surface of the automatic loader section 4.

First, the electric component control section 450 extends the pad rod 403 to the height at which the press plate P at the uppermost position in the cassette 9 can be held, referring to whether the cassette 9 which has reached the automatic loader section 4 by the sliding movement is at the first press plate transportation position or at the second press plate transportation position (here, the second press plate transportation position, because the cassette 9*b* has reached the automatic loader section 4) and also referring to how many plate plates P and interleaves S remain in the cassette 9. FIG. 7 shows the state where the pad rod 403 is thus extended. The electric component control section 450 causes the press plate P at the uppermost position in the cassette 9 to be held by the adsorption pad 401 provided at the tip of the pad rod 403.

Figure 8:
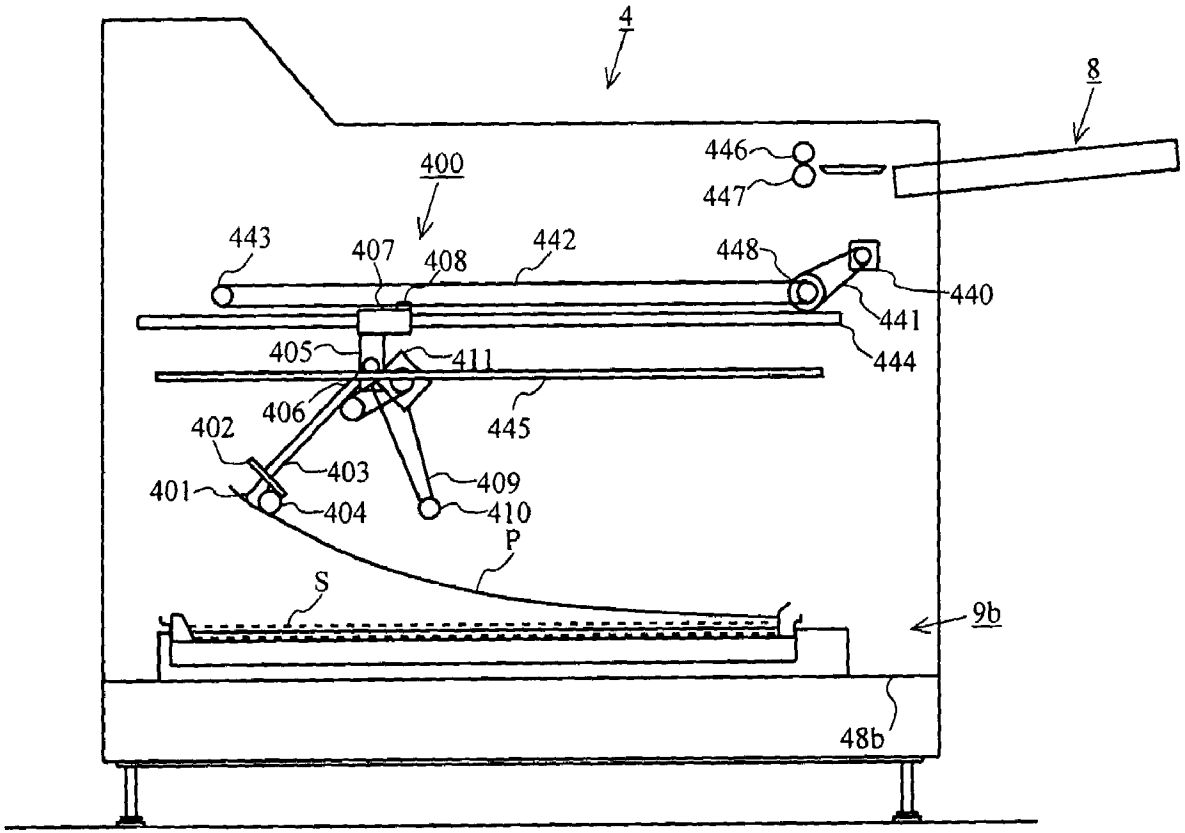
FIG. 8 is a view showing the overall operation of the press plate transportation mechanism 400, which is seen from the side surface of the automatic loader section 4.

Next, the electric component control section 450 drives the pad rod moving motor 411 to shorten the pad rod 403, and concurrently drives the loader moving motor 440 to move the pad rod 403 in a transportation movement direction (rightward in FIG. 7) while rotating the pad rod 403 in a transportation rotation direction (clockwise in FIG. 7). The operation of shortening the pad rod 403 and the operation of rotating and horizontally moving the pad rod 403 are performed concurrently in order to prevent the press plate P to be removed from contacting the press plates P and the interleaves S below the press plate P to be removed. The image recording system may be structured such that while the pad rod 403 is shortened as described above, a so-called paper separating operation is performed so as to remove the interleaf S adhering to the rear surface of the press plate P. FIG. 8 shows a state where the pad rod 403 is shortened to a desired length and the press plate P to be transported is lifted to a certain degree.

Figure 9:
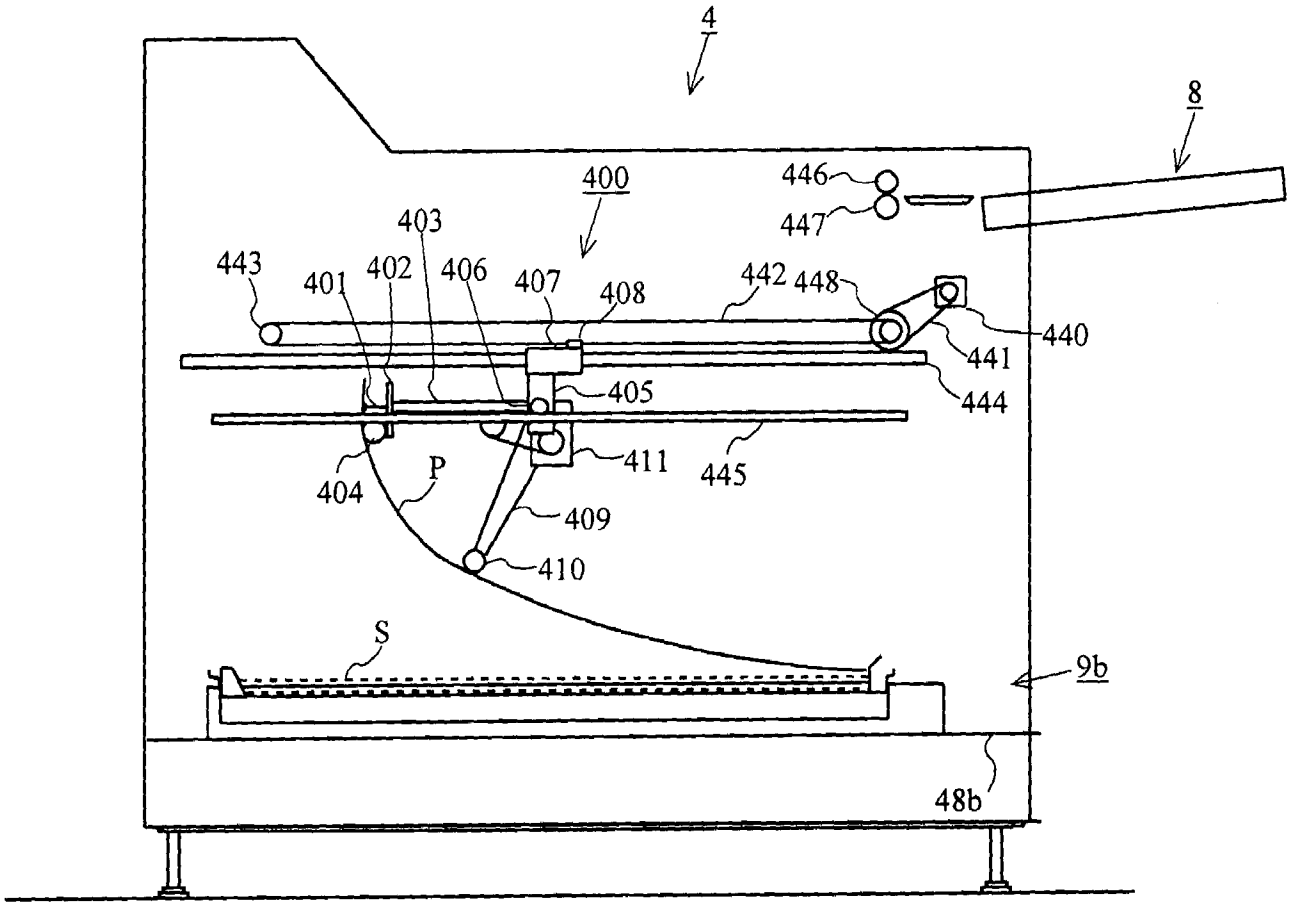
FIG. 9 is a view showing the overall operation of the press plate transportation mechanism 400, which is seen from the side surface of the automatic loader section 4.
Figure 10:
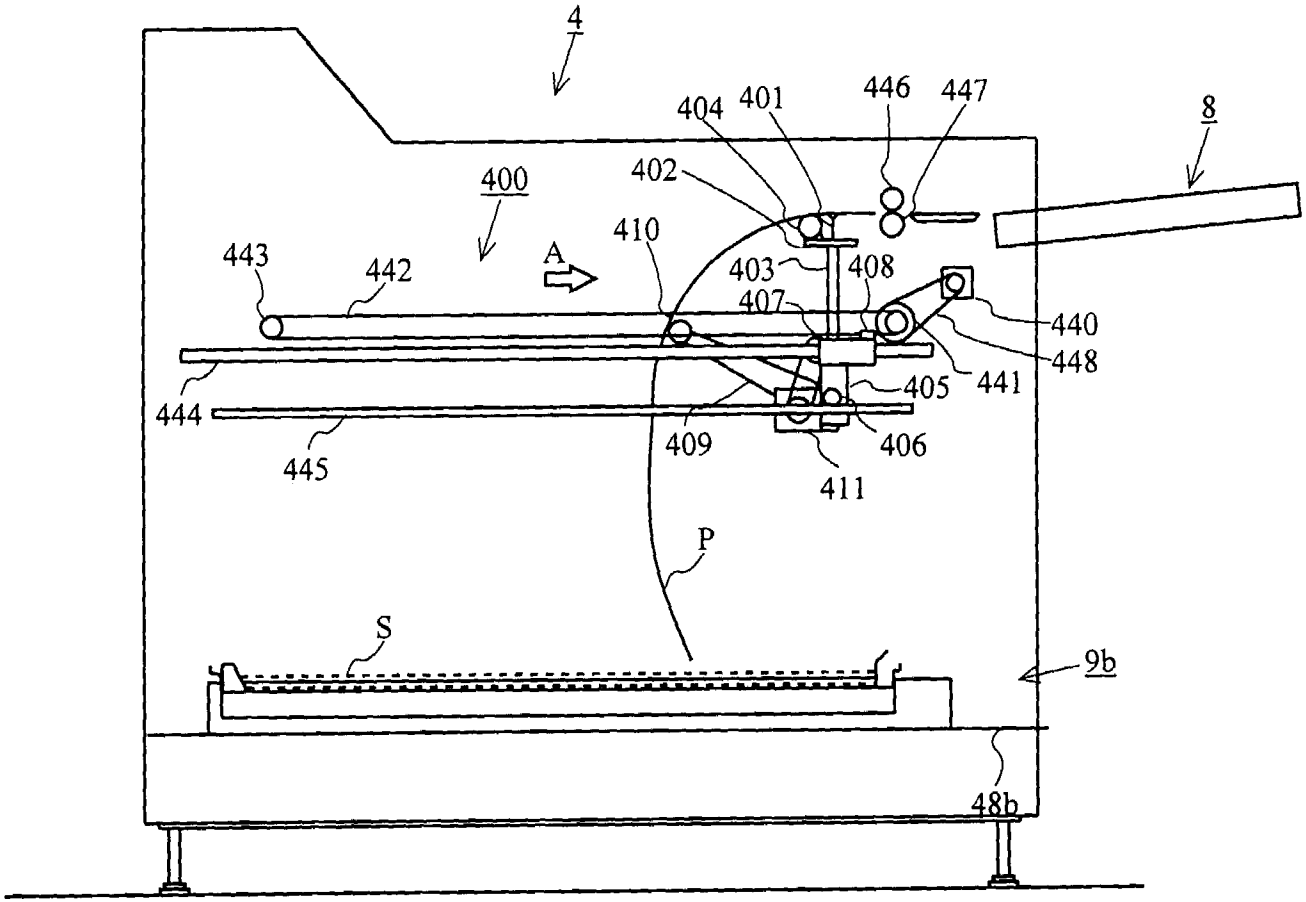
FIG. 10 is a view showing the overall operation of the press plate transportation mechanism 400, which is seen from the side surface of the automatic loader section 4.

When the linear bush holder 407 is driven by the loader moving motor 440 to move in the transportation movement direction, as shown in FIGS. 8 through 10, the pad rod 403 pivots in the transportation rotation direction around the axis of the connecting shaft provided on the decelerator 405. This causes the following operations. One end area of the support layer of the press plate P is adsorbed and thus held by the adsorption pad 401, and in this state, the linear bush holder 407 is driven by the loader moving motor 440 to move in the transportation movement direction as shown in FIGS. 8 through 10. When this occurs, the pad rod 403 pivots at 180° in the transportation rotation direction. By this pivoting, the press plate P adsorbed and held by the adsorption pad 401 is inverted upside down (i.e., such that the support layer is at the lower surface). Then, as shown in FIG. 10, the press plate P is held between a pair of transportation rollers 446 and 447 for transporting the press plate P with the leading end thereof directed toward the conveyor section 8. The above-described transportation operation is performed such that no friction is generated between the press plates P to be transported and the interleaves S loaded on the cassette 9.

As described above, according to the image recording material supply apparatus in Embodiment 1, for replacing the cassette 9 in the automatic loader section 4, the operation of retracting the cassette 9 to the cassette accommodation section 3 is performed in parallel with the operation of inserting a new cassette 9 into the automatic loader section 4 from the cassette accommodation section 3. Accordingly, the time required by the image recording material supply apparatus for the cassette replacement operation is either the time for retracting the cassette or the time for inserting the cassette (specifically, the longer time among these times). In other words, although the image recording materials cannot be transported from the image recording material supply apparatus to the image recording apparatus during the cassette replacement operation, the time in which the image recording material supply apparatus must stop the transportation of the image recording materials can be shortened. In addition, since the mechanism for vertically moving the cassette 9 is not necessary in the automatic loader section 4, the cost of the image recording material supply apparatus is reduced.

Cassette accommodation sections each accommodating a single cassette may be provide on both sides of an automatic loader section capable of accommodating a single cassette. In this case, a cassette is retracted from the automatic loader section to one of the cassette accommodation sections, and concurrently, another cassette is inserted into the automatic loader section from the other cassette accommodation section. Thus, substantially the same effects as those of Embodiment 1 can be provided. The automatic loader section transports press plates from a single press plate transportation position. Therefore, the present invention can be realized even if the-pad rod 403 in the press plate transportation mechanism 400 is not extendable.

Embodiment 2

Figure 11:
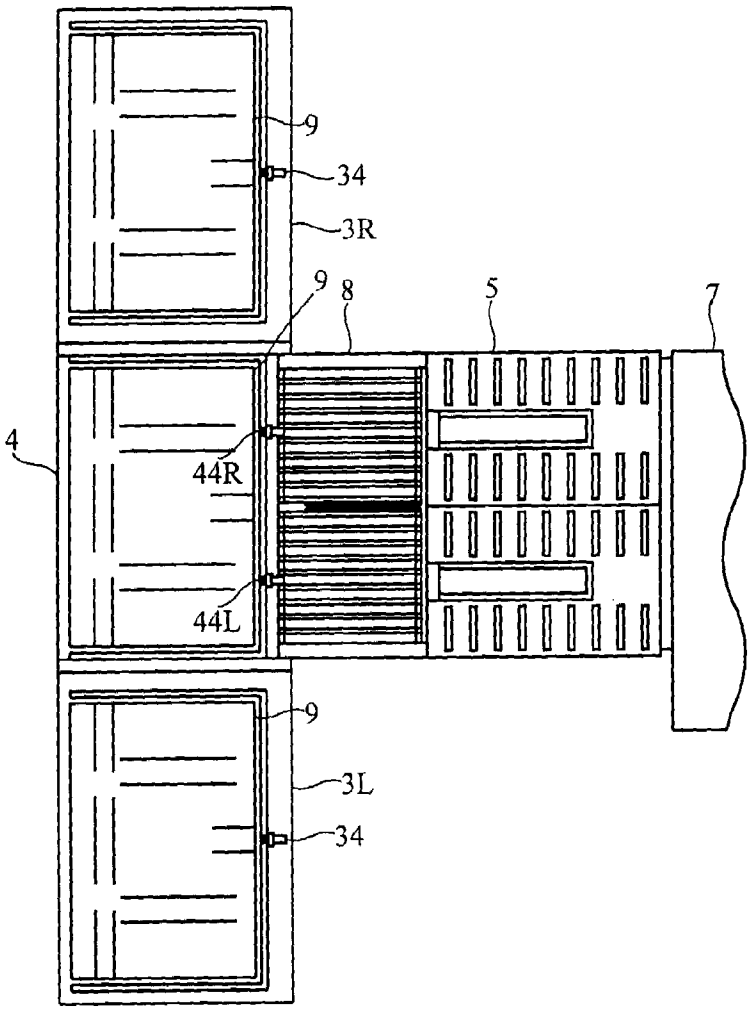
FIG. 11 is a schematic plan view of an image recording system including an image recording material supply apparatus according to Embodiment 2 of the present invention.

An image recording material supply apparatus according to Embodiment 2 of the present invention will be described. In Embodiment 2, an image recording material supply apparatus including cassette accommodation sections 3 on both sides of the automatic loader section 4 will be described. FIG. 11 is a schematic plan view of an image recording system including such an image recording material supply apparatus. In Embodiment 2, unlike in Embodiment 1, cassette accommodation sections 3L and 3R are provided on both sides of the automatic loader section 4, and accordingly motors 44L and 44R are provided. The structure of the image recording system in Embodiment 2 is substantially the same as that in Embodiment 1 except for the above points. Substantially the same parts as those in Embodiment 1 will bear identical reference numerals therewith and will-not be described in detail.

In FIG. 11, the cassette accommodation sections 3L and 3R are provided on both sides of the automatic loader section 4. The cassette accommodation sections 3L and 3R each accommodate a plurality of cassettes 9 stacked in a vertical direction, and the automatic loader section 4 removes a press plate P in the cassette 9 from the cassette accommodation section 3L or 3R and transports the press plate P. The cassette accommodation sections 3L and 3R each accommodate a plurality of cassettes 9 in a stacked manner like in Embodiment 1. For transporting a press plate P in such a cassette 9 to the image recording section 6, the cassette 9 accommodated in the cassette accommodation section 3L or 3R is moved by a sliding mechanism (FIG. 11 only shows motors 34, 44L, and 44R), controlled by the electric component control section 450, to the automatic loader section 4.

As shown in FIG. 11, by opening the top of the cassette accommodation sections 3L and 3R, the user can supplement a new press plate P to the cassette 9 located in each of the cassette accommodation sections 3L and 3R when necessary. The press plate P is, for example, a PS plate and includes a support layer and an image recording layer. The press plate P is accommodated in the cassette 9 in the state where the image recording layer thereof is at the lower surface. A plurality of press plates P may be supplied to the cassette 9 in the state where a plurality of interleaves S are stacked alternately therewith, in order to prevent friction between the press plates P.

Figure 12:
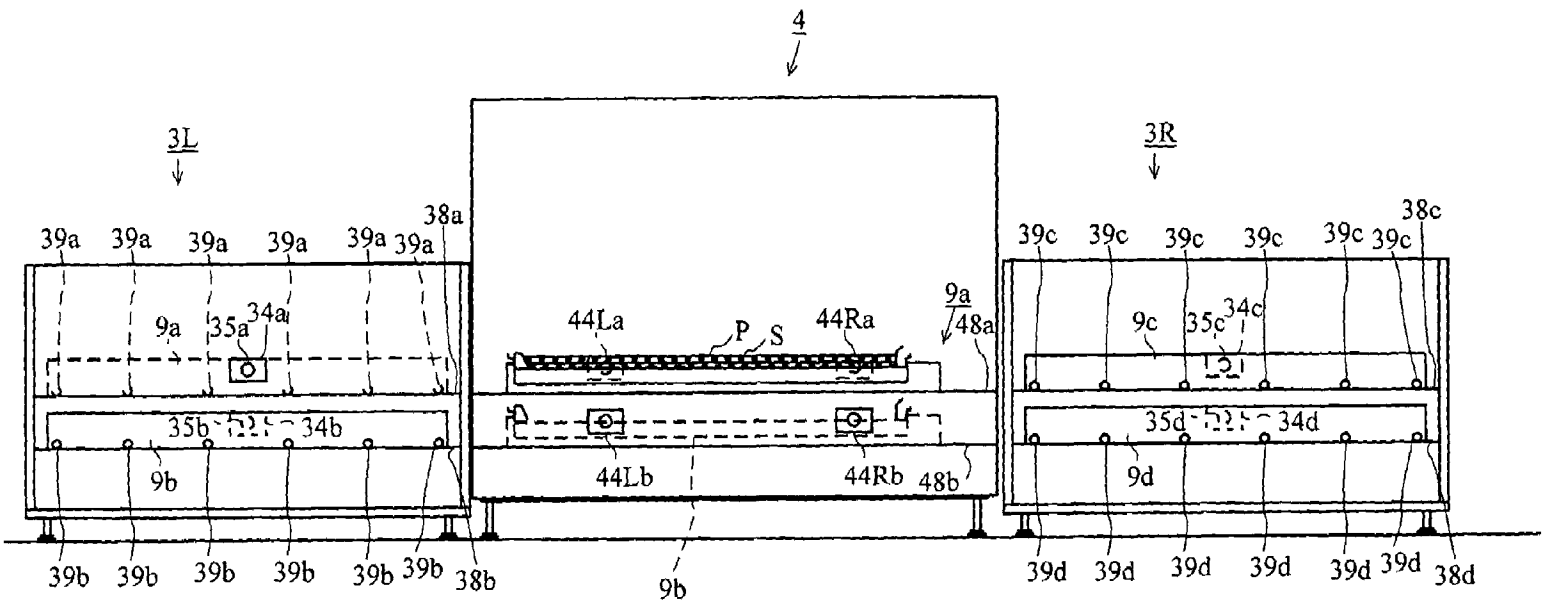
FIG. 12 is a side view showing a structure of cassette accommodation sections 3L and 3R and the automatic loader section 4 which are shown in FIG. 11, and of a sliding mechanism provided throughout each of the cassette accommodation sections 3L and 3R and the automatic loader section 4.
Figure 13:
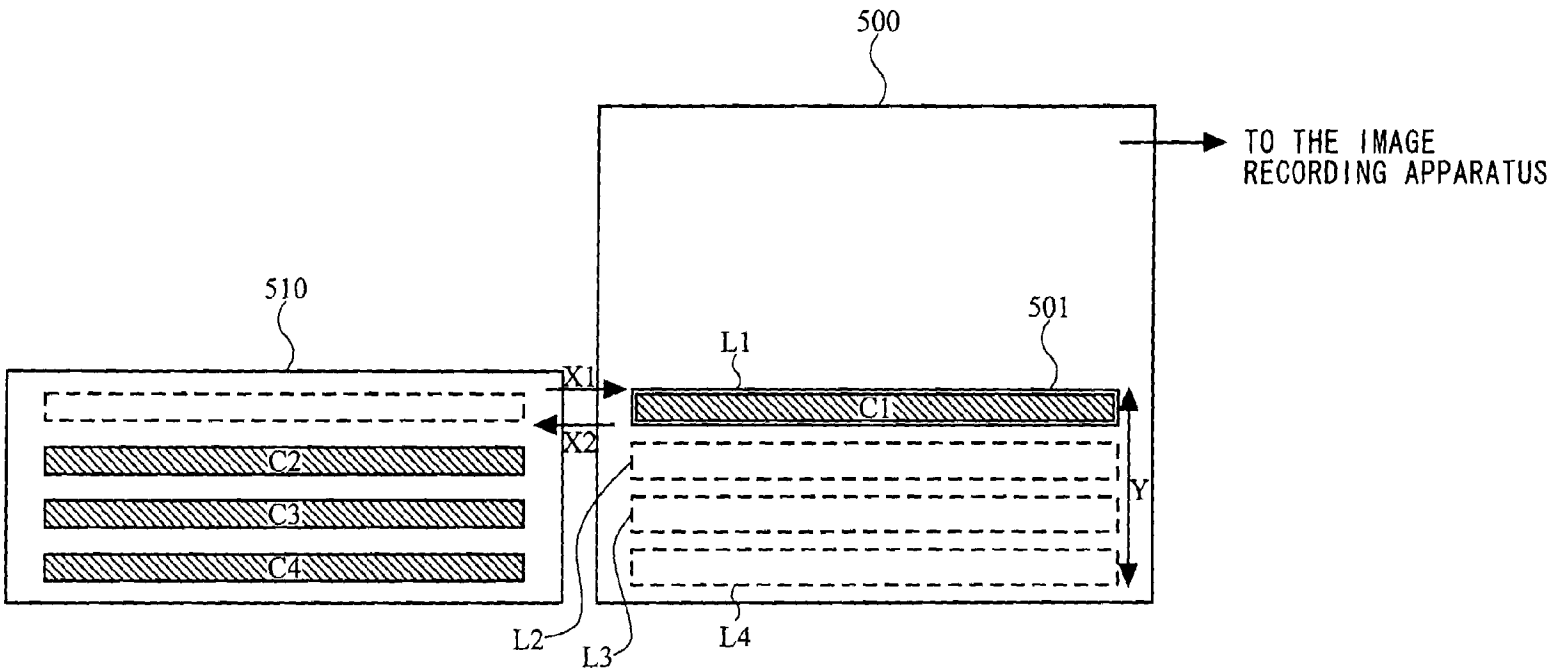
FIG. 13 PRIOR ART
FIG. 13 is a schematic view showing a structure of a conventional press plate supply apparatus 500 and a conventional cassette accommodation apparatus 510.

Hereinafter, with reference to FIG. 12, a structure of the cassette accommodation sections 3L and 3R and the automatic loader section 4 will be described. FIG. 12 is a side view showing a structure of the cassette accommodation sections 3L and 3R, the automatic loader section 4, and a sliding mechanism provided throughout each of the cassette accommodation sections 3L and 3R and the automatic loader section 4. The relationship between the cassettes 9 in the cassette accommodation sections 3L and 3R and the sliding mechanism is substantially the same as that described in Embodiment 1 with reference to FIG. 5.

In FIG. 12, a cassette 9 is structured to be movable back and forth between the cassette accommodation section 3L or 3R and the automatic loader section 4 by the sliding mechanism. In the automatic loader section 4, the side plate of the cassette 9 is not shown in order to show the press plate P and the interleaf S loaded thereon. Although a plurality of cassettes 9 are actually stacked in the cassette accommodation sections 3L and 3R, a specific description will be given below using two cassettes 9*a* and 9*b* located in the cassette accommodation section 3L and two cassettes 9*c* and 9*d* located in the cassette accommodation section 3R as representative cassettes.

As can be clearly seen from FIG. 12, the image recording system in Embodiment 2 has a structure in which the cassette accommodation section 3R is added to the automatic loader section 4 and the cassette accommodation section 3 in Embodiment 1. Here, the cassette accommodation section 3L is regarded as the cassette accommodation section 3 in Embodiment 1. Namely, the cassette accommodation section 3L has substantially the same structure as that of the cassette accommodation section 3 in Embodiment 1. Thus, substantially the same parts as those of the cassette accommodation section 3 in Embodiment 1 will bear identical reference numerals therewith and will not be described in detail. Hereinafter, the cassette accommodation section 3R will be mainly described.

The cassettes 9*c* and 9*d* respectively include outer trays 21*c* and 21*d*. Side plates on one side of the outer trays 21*c* and 21*d* of the cassettes 9*c* and 9*d* are respectively provided with a plurality of rollers 39*c* and 39*d*. The plurality of rollers 39*c* and 39*d* are respectively supported by support rails 38*c* and 38*d* which are horizontally provided in the cassette accommodation section 3R. The support rails 38*c* and 38*d* are extended in the sliding-movable direction at the height corresponding to the support rails 48*a* and 48*b* provided in the automatic loader section 4. The side plates on the other side of the outer trays 21*c* and 21*d* of the cassettes 9*c* and 9*d* are also respectively provided with a plurality of rollers 36*c* and 36*d* (not shown in FIG. 12). The plurality of rollers 36*c* and 36*d* are respectively engaged with guide members 37*c* and 37*d* (not shown in FIG. 12) provided in the cassette accommodation section 3, parallel to the support rails 38*c* and 38*d*. The guide members 37*c* and 37*d* are extended in the sliding-movable direction at the height corresponding to guide rails (not shown) provided in the automatic loader section 4. In other words, the plurality of rollers 36*c*, 36*d*, 39*c* and 39*d* are respectively supported by the guide members 37*c*, 37*d* and the support rails 38*c* and 38*d*. By this structure, the cassettes 9*c* and 9*d* are stacked in the vertical direction in the cassette accommodation section 3R, in a state movable in the sliding-movable direction. When the cassettes 9*c* and 9*d* have reached the automatic loader section 4, the plurality of rollers 39*c* and 39*d* are supported by the support rails 48*a* and 48*b*, and the plurality of rollers 36*c* and 36*d* are supported by the guide members in the automatic loader section 4.

The side plates on the other side of the outer trays 21*c* and 21*d* of the cassettes 9*c* and 9*d* are also provided respectively with racks 33*c* and 33*d* (not shown), which are extended over the entire length of the side plates in the sliding-movable direction. The racks 33*c* and 33*d* can be respectively in mesh with pinions 35*c* and 35*d*, which are respectively driven to rotate by motors 34*c* and 34*d* provided in the cassette accommodation section 3R respectively for the support rails 38*c* and 38*d*. The racks 33*c* and 33*d* can also be respectively in mesh with pinions which are driven to rotate by motors 44Ra and 44Rb provided in the automatic loader section 4 respectively for the support rails 48*a* and 48*b*. The racks 33*c* and 33*d* can further be respectively in mesh with pinions which are driven to rotate by motors 44La and 44Lb provided in the automatic loader section 4 respectively for the support rails 48*a* and 48*b*. Accordingly, the cassettes 9*c* and 9*d* are driven by the motors 34*c*, 34*d*, 44Ra, 44Rb, 44La and 44Lb to move in the sliding-movable direction between the cassette accommodation section 3R and the automatic loader section 4 along the support rails 38*c*, 38*d*, 48*a* and 48*b*.

Here, the cassettes 9*a* and 9*c* and the first press plate transportation position (specifically, the position of the cassette 9*a* represented with the solid line in FIG. 12) will be especially described. For replacing the cassette 9 in the automatic loader section 4, the operation of retracting the cassette 9*a* from the first press plate transportation position to the cassette accommodation section 3L can be performed in parallel with the operation of inserting the cassette 9*c* accommodated in the cassette accommodation section 3R to the first press plate transportation position. The operation of retracting the cassette 9*c* from the first press plate transportation position to the cassette accommodation section 3R can be performed in parallel with the operation of inserting the cassette 9*a* accommodated in the cassette accommodation section 3L to the first press plate transportation position. In the case where the cassette 9*c* is not accommodated in the automatic loader section 4, the cassette accommodation section 3L or the cassette accommodation section 3R, the cassette 9*a* can be horizontally moved to the first press plate transportation position from the cassette accommodation section 3L and then horizontally moved to the cassette accommodation section 3R (specifically, the position of the cassette 9*c* in FIG. 12). Such operations of the cassettes 9 are applicable to the cassettes 9*b* and 9*d* movable with respect to the second press plate transportation position (the position of the cassette 9*b* represented with the dashed line in FIG. 12)

Accordingly, in the case where the cassette accommodation sections 3L and 3R each accommodate two cassettes 9 stacked in a vertical direction, four cassettes 9 can be selectively moved in the sliding-movable direction with respect to the automatic loader section 4. The variation of the manner of horizontally moving the cassettes 9 becomes wider, and it is possible to determine the procedure of the horizontal movement of the cassettes 9 in accordance with the form of work. In this case, the electric component control section 450 selects a cassette 9 having a desired type of press plates P loaded thereon from the cassette accommodation sections 3R and 3R. The electric component control section 450 moves the selected cassette 9 by the sliding movement from the cassette accommodation section 3L or 3R to the automatic loader section 4, and in this manner, locates the cassette 9 at the first or second press plate transportation position in the automatic loader section 4.

In Embodiment 2, the motors 44L and 44R are provided in the automatic loader section 4. Alternatively, one motor may be provided for one press plate transportation position. For example, the motors 44Ra and 44Rb may be removed from the structure shown in FIG. 12, and the motors 44La and 44Lb may be located at substantially the center of the automatic loader section 4. The motors 34*a* through 34*d* may be moved closer to the automatic loader section 4 such that the racks 33 of the cassettes 9 do not have any non-meshed area. In this manner, substantially the same horizontal movement of the cassettes 9 as that described above can be realized with a smaller number of motors 44.

As described above, according to the image recording material supply apparatus in Embodiment 2, for replacing the cassette 9 in the automatic loader section 4, the operation of retracting the cassette 9 to the cassette accommodation section 3L or 3R is performed in parallel with the operation of inserting a new cassette 9 into the automatic loader section 4 from the cassette accommodation section 3L or 3R. Accordingly, the time required by the image recording material supply apparatus for the cassette replacement operation is either the time for retracting the cassette or the time for inserting the cassette (specifically, the longer time among these times). In other words, although the image recording materials cannot be transported from the image recording material supply apparatus to the image recording apparatus during the cassette replacement operation, the time in which the image recording material supply apparatus must stop the transportation of the image recording materials can be shortened. In addition, since the mechanism for vertically moving the cassette 9 is not necessary in the automatic loader section 4, the cost of the image recording material supply apparatus is reduced. In Embodiment 2, the types of usable cassettes 9 are diversified and the variation of the manner of horizontally moving the cassettes 9 becomes wider, and it is possible to optimize the procedure in accordance with the form of work.

In a cassette 9, a plurality of different sizes of press plates P may be accommodated side by side. By providing a positioning member for positioning various sizes of press plates on the bottom surface of a press plate loading plate of the cassette 9, the various sizes of press plates P can be accommodated stably. The cassette 9 does not need to have the double tray structure having the inner tray 22 and the outer tray 21.

While the invention has been described in detail, the foregoing description is in all aspects illustrative and not restrictive. It is understood that numerous other modifications and variations can be devised without departing from the scope of the invention.

What is claimed is:

1. An image recording material supply apparatus for transporting and supplying an image recording material at an uppermost position among image recording materials loaded on a cassette, the image recording material supply apparatus comprising:

a transportation mechanism for transporting an image recording material at an uppermost position among image recording materials loaded on a cassette located at a predetermined image recording material transportation position;

a cassette accommodation section for accommodating a plurality of cassettes;

a cassette moving mechanism for moving at least two of the plurality of cassettes between the cassette accommodation section and the image recording material transportation position in a cassette replacement operation; and a control section for controlling an operation of the cassette moving mechanism for moving the at least two cassettes for the cassette replacement operation;

wherein the control section controls the operation of the cassette moving mechanism to perform a moving operation of retracting one of the at least two cassettes for the cassette replacement operation from the image recording material transportation position to the cassette accommodation section, concurrently with a moving operation of supplying another of the at least two cassettes for the cassette replacement operation from the cassette accommodation section to the image recording material transportation position.

2. An image recording material supply apparatus according to claim 1, wherein:

the transportation mechanism transports an image recording material at an uppermost position among image recording materials loaded on a cassette located at either one of a first image recording material transportation position and a second image recording material transportation position which are different from each other in a vertical direction;

the cassette accommodation section has a first cassette accommodation position and a second cassette accommodation position as positions at which the cassettes are to be accommodated, the first cassette accommodation position and the second cassette accommodation position being respectively horizontal with the first image recording material transportation position and the second image recording material transportation position;

the cassette moving mechanism comprises:

a first sliding movement mechanism for horizontally moving one of the at least two cassettes for the cassette replacement operation back and forth between the first image recording material transportation position and the first cassette accommodation position, and a second sliding movement mechanism for horizontally moving another of the at least two cassettes for the cassette replacement operation back and forth between the second image recording material transportation position and the second cassette accommodation position; and the control section controls such that:

an operation of the first sliding movement mechanism of horizontally moving one of the at least two cassettes for the cassette replacement operation to the first cassette accommodation position is performed in parallel with an operation of the second sliding movement mechanism of horizontally moving another of the at least two cassettes for the cassette replacement operation to the second image recording material transportation position, and an operation of the second sliding movement mechanism of horizontally moving one of the at least two cassettes for the cassette replacement operation to the second cassette accommodation position is performed in parallel with an operation of the first sliding movement mechanism of horizontally moving another of the at least two cassettes for the cassette replacement operation to the first image recording material transportation position.

3. An image recording material supply apparatus according to claim 1, wherein:

the cassette accommodation section has a first cassette accommodation position and a second cassette accommodation position as positions at which the cassettes are to be accommodated, the first cassette accommodation position and the second cassette accommodation position being provided on both sides of, and horizontal with, the image recording material transportation position;

the cassette moving mechanism comprises:

a first sliding movement mechanism for horizontally moving one of the at least two cassettes for the cassette replacement operation back and forth between the image recording material transportation position and the first cassette accommodation position, and a second sliding movement mechanism for horizontally moving another of the at least two cassettes for the cassette replacement operation back and forth between the image recording material transportation position and the second cassette accommodation position; and the control section controls such that:

an operation of the first sliding movement mechanism of horizontally moving one of the at least two cassettes for the cassette replacement operation to the first cassette accommodation position is performed in parallel with an operation of the second sliding movement mechanism of horizontally moving another of the at least two cassettes for the cassette replacement operation to the image recording material transportation position, and an operation of the second sliding movement mechanism of horizontally moving one of the at least two cassettes for the cassette replacement operation to the second cassette accommodation position is performed in parallel with an operation of the first sliding movement mechanism of horizontally moving another of the at least two cassettes for the cassette replacement operation to the image recording material transportation position.

4. An image recording material supply apparatus according to claim 1, wherein:

the transportation mechanism transports an image recording material at an uppermost position among image recording materials loaded on a cassette located at either one of a first image recording material transportation position and a second image recording material transportation position which are different from each other in a vertical direction;

the cassette accommodation section has a first cassette accommodation position, a second cassette accommodation position, a third cassette accommodation position, and a fourth cassette accommodation position as positions at which the plurality of cassettes are to be accommodated, the first cassette accommodation position and the second cassette accommodation position being provided on both sides of, and horizontal with, the first image recording material transportation position, and the third cassette accommodation position and the fourth cassette accommodation position being provided on both sides of, and horizontal with, the second image recording material transportation position;

the cassette moving mechanism comprises:

a first sliding movement mechanism for horizontally moving one of the plurality of cassettes back and forth between the first image recording material transportation position and the first cassette accommodation position, a second sliding movement mechanism for horizontally moving one of the plurality of cassettes back and forth between the first image recording material transportation position and the second cassette accommodation position, a third sliding movement mechanism for horizontally moving one of the plurality of cassettes back and forth between the second image recording material transportation position and the third cassette accommodation position, and a fourth sliding movement mechanism for horizontally moving one of the plurality of cassettes back and forth between the second image recording material transportation position and the fourth cassette accommodation position; and the control section controls such that an operation of the sliding movement mechanism corresponding to the cassette located at the first or second image recording material transportation position of horizontally moving the cassette to the corresponding cassette accommodation section is performed in parallel with an operation of another one of the sliding movement mechanisms of horizontally moving another cassette to the first or second image recording material transportation position.

5. An image recording material supply method for transporting and supplying an image recording material at an uppermost position among image recording materials loaded on a cassette, the image recording material supply method comprising the steps of:

accommodating a plurality of cassettes in advance;

transporting an image recording material at an uppermost position among image recording materials loaded on a cassette located at a predetermined image recording material transportation position; and replacing the cassette located at the image recording material transportation position by retracting the cassette located at the image recording material transportation position to a cassette accommodation position, concurrently with supplying another cassette accommodated in advance to the image recording material transportation position.

6. An image recording material supply method according to claim 5, comprising the steps of:

transporting an image recording material at an uppermost position among image recording materials loaded on a cassette located at either one of a first image recording material transportation position and a second image recording material transportation position which are different from each other in a vertical direction;

accommodating, in advance, the cassettes at a first cassette accommodation position and a second cassette accommodation position provided respectively horizontal with the first image recording material transportation position and the second image recording material transportation position;

for replacing the cassette located at the first image recording material transportation position, retracting the cassette located at the first image recording material transportation position to the first cassette accommodation position, concurrently with supplying another cassette accommodated at the second cassette accommodation position to the second image recording material transportation position; and for replacing the cassette located at the second image recording material transportation position, retracting the cassette located at the second image recording material transportation position to the second cassette accommodation position, concurrently with supplying another cassette accommodated at the first cassette accommodation position to the first image recording material transportation position.

7. An image recording material supply method according to claim 5, comprising the steps of:

accommodating, in advance, the cassettes at a first cassette accommodation position and a second cassette accommodation position provided on both sides of, and horizontal with, the image recording material transportation position; and for replacing the cassette located at the image recording material transportation position, retracting the cassette located at the image recording material transportation position to the first cassette accommodation position, concurrently with supplying another cassette accommodated at the second cassette accommodation position to the image recording material transportation position, or retracting the cassette located at the image recording material transportation position to the second cassette accommodation position, concurrently with supplying another cassette accommodated at the first cassette accommodation position to the image recording material transportation position.

8. An image recording material supply method according to claim 5, comprising the steps of:

transporting an image recording material at an uppermost position among image recording materials loaded on a cassette located at either one of a first image recording material transportation position and a second image recording material transportation position which are different from each other in a vertical direction;

accommodating, in advance, the cassettes at a first cassette accommodation position and a second cassette accommodation position provided on both sides of, and horizontal with, the first image recording material transportation position, and at a third cassette accommodation position and a fourth cassette accommodation position provided on both sides of, and horizontal with, the second image recording material transportation position; and for replacing the cassette located at the first or second image recording material transportation position, retracting the cassette to one of the first, second, third and fourth cassette accommodation positions, concurrently with supplying another cassette accommodated at one of the cassette accommodation positions, which is different from the cassette accommodation position to which the cassette is retracted, to the first or second image recording material transportation position.

* * * * *